US007494318B2

(12) United States Patent
Kozerski

(10) Patent No.: US 7,494,318 B2
(45) Date of Patent: Feb. 24, 2009

(54) METHODS AND APPARATUS USEFUL FOR SERVICING ENGINES

(75) Inventor: James John Kozerski, West Chester, OH (US)

(73) Assignee: General Electric Company, Schenectady, NY (US)

( * ) Notice: Subject to any disclaimer, the term of this patent is extended or adjusted under 35 U.S.C. 154(b) by 729 days.

(21) Appl. No.: 11/056,609

(22) Filed: Feb. 11, 2005

(65) Prior Publication Data

US 2006/0182629 A1 Aug. 17, 2006

(51) Int. Cl.
*F01D 9/00* (2006.01)

(52) U.S. Cl. ..... 415/209.3; 29/889.21

(58) Field of Classification Search ..... 415/209.4, 415/209.3; 29/889.21
See application file for complete search history.

(56) References Cited

U.S. PATENT DOCUMENTS

| | | | | |
|---|---|---|---|---|
| 4,073,599 | A * | 2/1978 | Allen et al. | 416/97 R |
| 4,119,389 | A | 10/1978 | Gee | |
| 4,611,464 | A | 9/1986 | Hetzer et al. | |
| 4,920,744 | A | 5/1990 | Garcia et al. | |
| 5,150,567 | A | 9/1992 | Farrell | |
| 5,174,105 | A | 12/1992 | Hines | |
| 5,366,313 | A | 11/1994 | LaBarre | |
| 5,381,986 | A | 1/1995 | Smith et al. | |
| 5,419,112 | A | 5/1995 | Farrell | |
| 6,314,630 | B1 | 11/2001 | Munk et al. | |
| 6,808,143 | B2 | 10/2004 | Munk et al. | |
| 6,860,716 | B2 | 3/2005 | Czachor et al. | |
| 2004/0240987 | A1 | 12/2004 | Czachor et al. | |

FOREIGN PATENT DOCUMENTS

| | | |
|---|---|---|
| EP | 0 345 834 A1 | 12/1989 |
| EP | 1482130 A2 | 12/2004 |
| GB | 777742 | 6/1957 |

OTHER PUBLICATIONS

International Search Report; Place of Search—Munich; Application No./Patent No. 06250624.10-2315; Dated May 19, 2006; 6 pgs.

* cited by examiner

*Primary Examiner*—Richard Edgar
(74) *Attorney, Agent, or Firm*—William Scott Andes, Esq.; Armstrong Teasdale LLP

(57) ABSTRACT

A seal/locking apparatus includes a tapered cover, a locking cap, and a housing. The housing has a opening configured to engage, in a first part of the opening, the tapered cover, and, in a second part of the opening, the locking cap. The tapered cover and the locking cap are configured to cooperate in preventing removal of either from the housing when both are engaged in the opening unless said locking cap is removed first. The seal/locking apparatus is particularly useful when attached to aircraft engines and can be used for replacement of an individual strut in an engine.

19 Claims, 6 Drawing Sheets

METHODS AND APPARATUS USEFUL FOR SERVICING ENGINES

BACKGROUND OF THE INVENTION

This invention relates generally to method and apparatus for servicing of aircraft engines and more particularly to methods and apparatus for on-line servicing of struts in aircraft engines.

At least one known aircraft engine includes struts at an edge of a fan cowling. These struts comprise a front frame, which holds the front of the engine to pylons. There is also another strut at the rear frame, also called the "diffuser wall" throughout this description. Using large lugs, an engine is typically hung by the diffuser wall and pinned to an aircraft. A ring with radial struts in it forms a weldment and holds the engine.

When a strut is worn or defective for some reason, it must be removed and replaced. In known methods for replacing aft or rear struts, the engine must be removed from the aircraft to which it is hung. The engine is then shipped to a repair facility to be rebuilt. This off-line method of servicing constitutes a major, labor-intensive and expensive engine overhaul.

BRIEF DESCRIPTION OF THE INVENTION

Some aspects of the present invention therefore provide a seal/locking apparatus that includes a tapered cover, a locking cap, and a housing. The housing has a opening configured to engage, in a first part of the opening, the tapered cover, and, in a second part of the opening, the locking cap. The tapered cover and the locking cap are configured to cooperate in preventing removal of either from the housing when both are engaged in the opening unless said locking cap is removed first.

In other aspects, the present invention provides an aircraft engine amenable to servicing of portions therein. The aircraft engine includes a rear frame hub, a removable strut having an engagement member configured to engage the rear frame hub and a diffuser wall having a slot therein. The engine also has a housing having an opening therein attached to the diffuser wall, so that the slot is under a longitudinal axis of the opening in the housing. Also provided is a tapered cover and a locking cap. The tapered cover is configured to engage in a first part of the opening and the locking cap is configured to engage in a second portion of the opening. Moreover, the tapered cover and the locking cap are configured to cooperate in preventing removal of either from the housing when both are engaged in the opening unless the locking cap is removed first. Also, the tapered cover is configured to engage the removable strut when the removable strut is engaged with the rear frame hub and the tapered covered is engaged with the housing.

In yet another aspect, the present invention provides a method for servicing a strut in an aircraft engine. The method includes inserting a strut in the engine, inserting and engaging a cover of a seal/locking apparatus in a first part of an opening of a housing of the seal/locking apparatus to compressively engage the strut between a hub of the engine and the cover through a slot in a diffuser wall of the engine. The method also includes engaging a locking cap with the cover and the housing of the seal/locking apparatus in a second part of the opening of the housing to thereby effectively lock and seal the seal/locking apparatus.

It will be appreciated that configurations of the present invention provide enhanced on-line servicing capabilities for engines by, among other things, permitting on-line servicing of a single strut in an engine.

DETAILED DESCRIPTION OF THE INVENTION

As used herein, the term "servicing" a strut of an engine is intended to encompass the act of inserting a strut, removing a strut, or both (e.g., replacing a strut).

Figure 1:
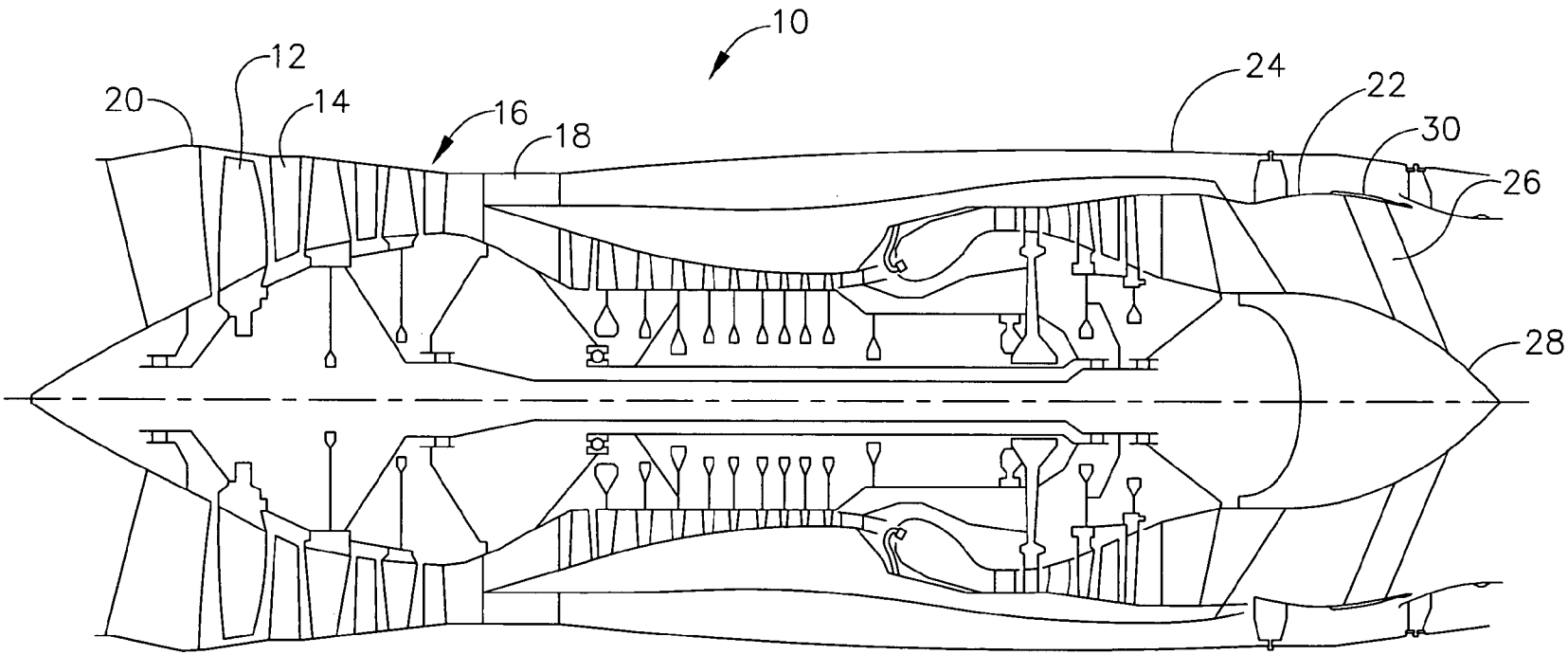
FIG. 1 is a cross sectional view of an engine.
Figure 2:
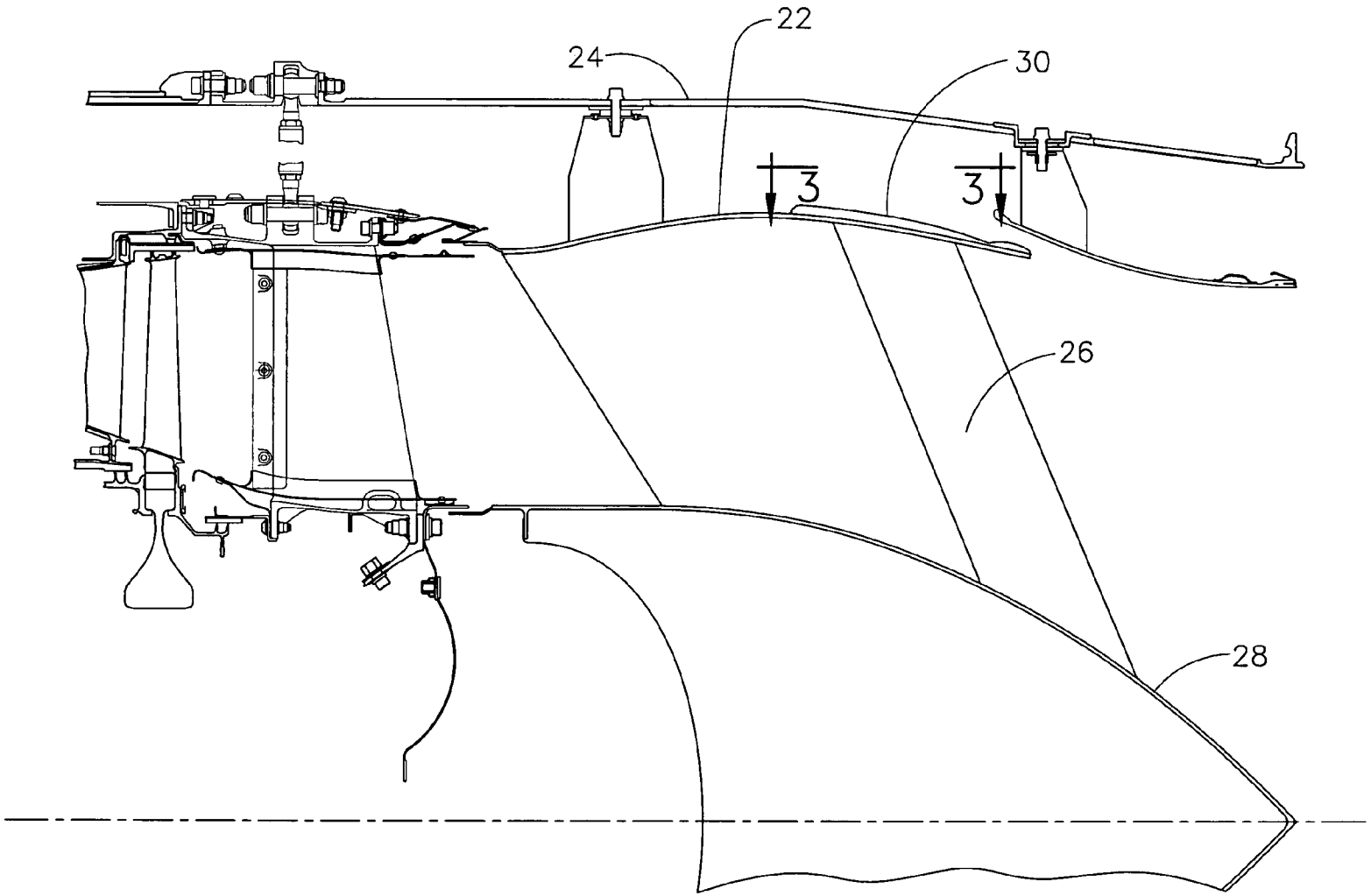
FIG. 2 is a cross sectional view of the rear portion of the engine shown in FIG. 1.

In some configurations of the present invention and referring to FIG. 1, an aircraft engine 10 comprises, at its front portion, a fan 12, fan stators 14, a fan cowling 16, and front struts 18. Struts 18 comprise a front frame 20, which holds onto engine 10 when it is pinned to pylons (not shown in FIG. 1.) At the rear of engine 10, there is a rear diffuser wall 22, a rear frame 24, rear struts 26, and a hub 28. Rear frame 24 also holds onto engine 10. The rear portion of engine 10 is illustrated in greater detail in FIG. 2.

Figure 3:
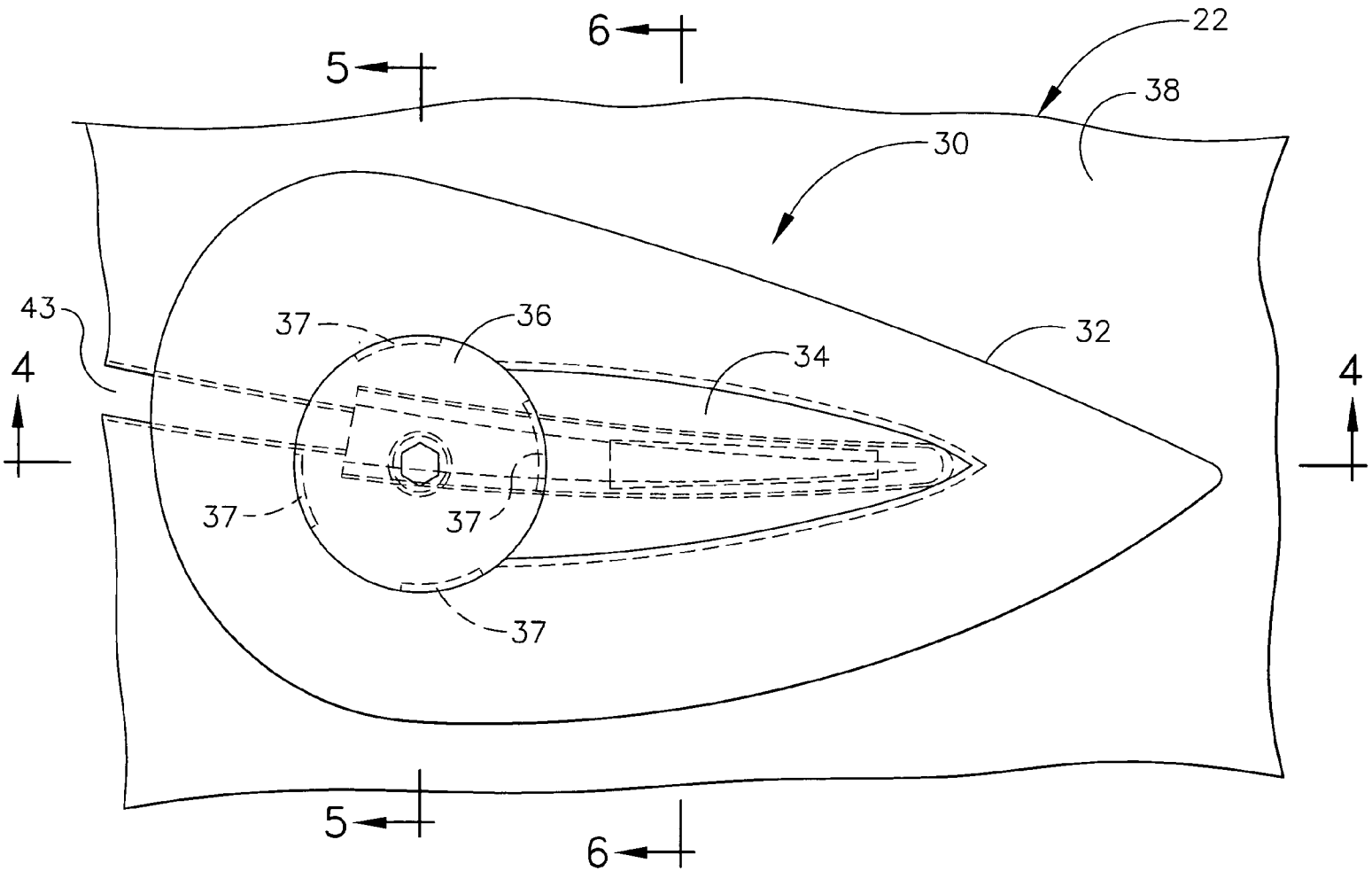
FIG. 3 is a top view of the seal/locking apparatus of FIG. 2, including part of the engine, as indicated by lines 3-3 in FIG. 2, wherein dashed lines indicate edges hidden from view by other surfaces.

More particularly and referring to FIG. 3, a seal/locking apparatus 30 useful as an apparatus for servicing an aircraft engine is provided having a housing 32, a tapered cover 34, and a locking cap 36. Housing 32, in some configurations, is brazed or otherwise affixed to an outside portion 38 of diffuser wall 22. Cover 34 is configured to slide into housing 32, and housing 32 is configured to engage cover 34 in a first, tapered part of opening 35.

Figure 4:
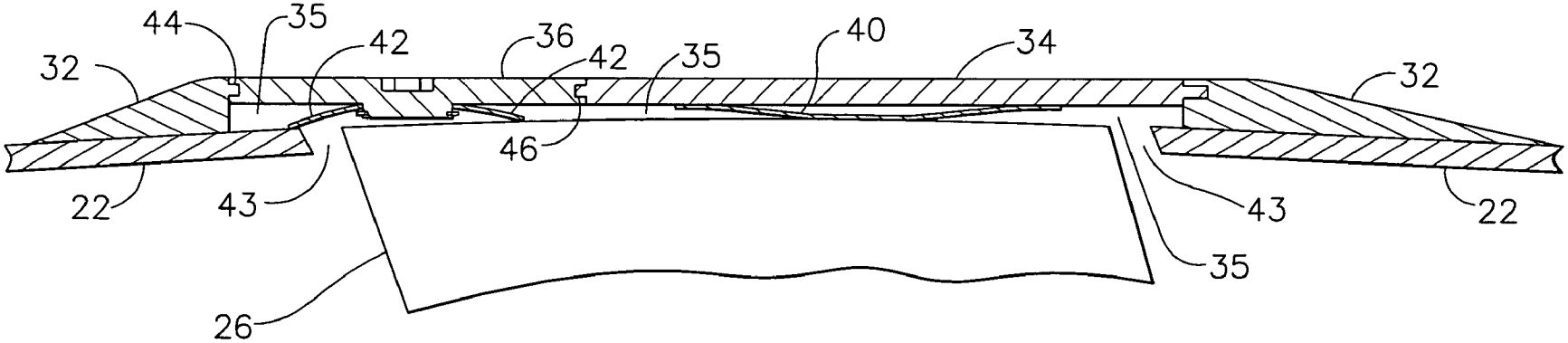
FIG. 4 is a cross sectional view of the seal/locking apparatus and a portion of the engine of FIG. 3, as indicated by lines 4-4 in FIG. 3.
Figure 5:
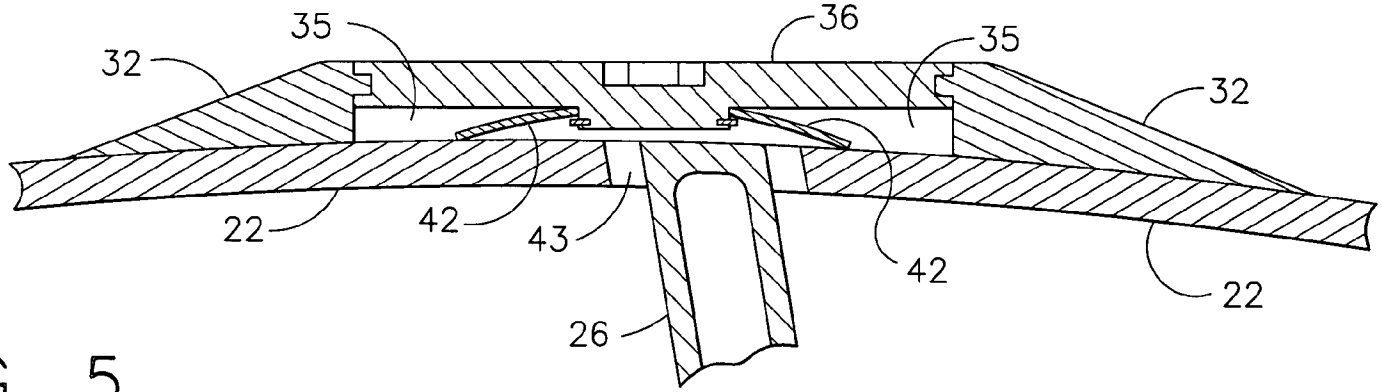
FIG. 5 is a cross sectional view of the seal/locking apparatus and a portion of the engine of FIG. 3, as indicated by lines 5-5 in FIG. 3.
Figure 6:
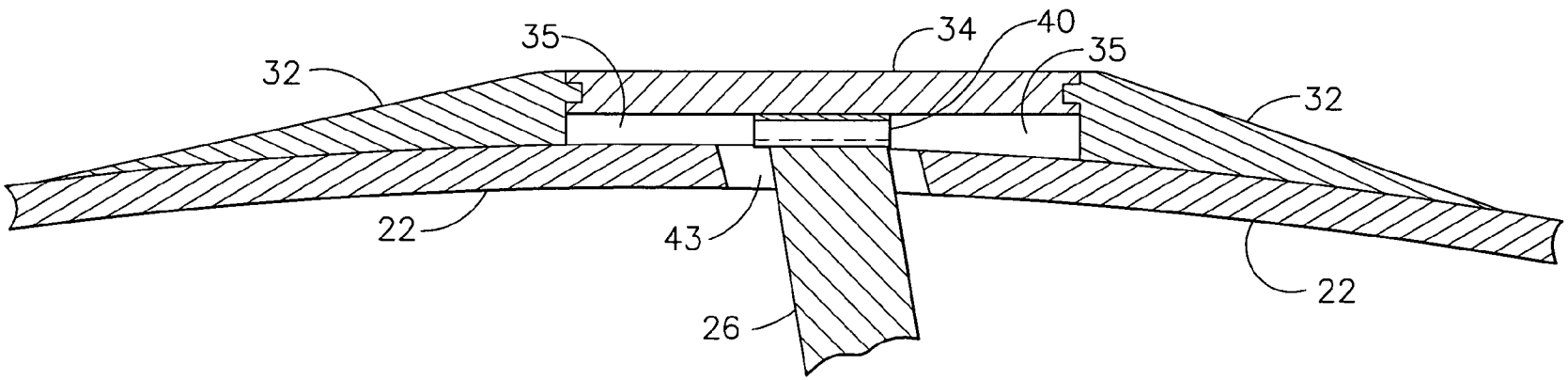
FIG. 6 is a cross sectional view of the seal/locking apparatus and a portion of the engine of FIG. 3, as indicated by lines 6-6 in FIG. 3.

Also in some configurations and referring to FIGS. 4, 5, and 6 a leaf spring 40 is attached to an inside portion of cover 34. As cover 34 is slid into housing 32, leaf spring 40 pushes against strut 26. After cover 34 is in place, locking cap 36 is then positioned in place. Locking cap 36 and cover 34 are configured to cooperate in preventing removal of either from housing 32 when both are engaged in opening 35 unless locking cap 36 is removed first. Locking cap 36 in some configurations locks seal/locking apparatus 30 by rotation. For example, locking cap 36 can include a bayonet mount, which in some configurations, comprises slots 37 in cap 36 configured to engage one or more locking lugs 44 in housing 32 and one or more locking lug or lugs 46 in cover 34 when cap 36 is rotated, thereby holding both cover 34 and locking cap 36 in place unless locking cap 36 is removed first. Some configurations of locking cap 36 also include a spring washer 42 therein. Spring washer 42, for example, is configured to compressively engage housing 32 and cover 34 as locking cap 36 is fitted into apparatus 30.

Figure 7:
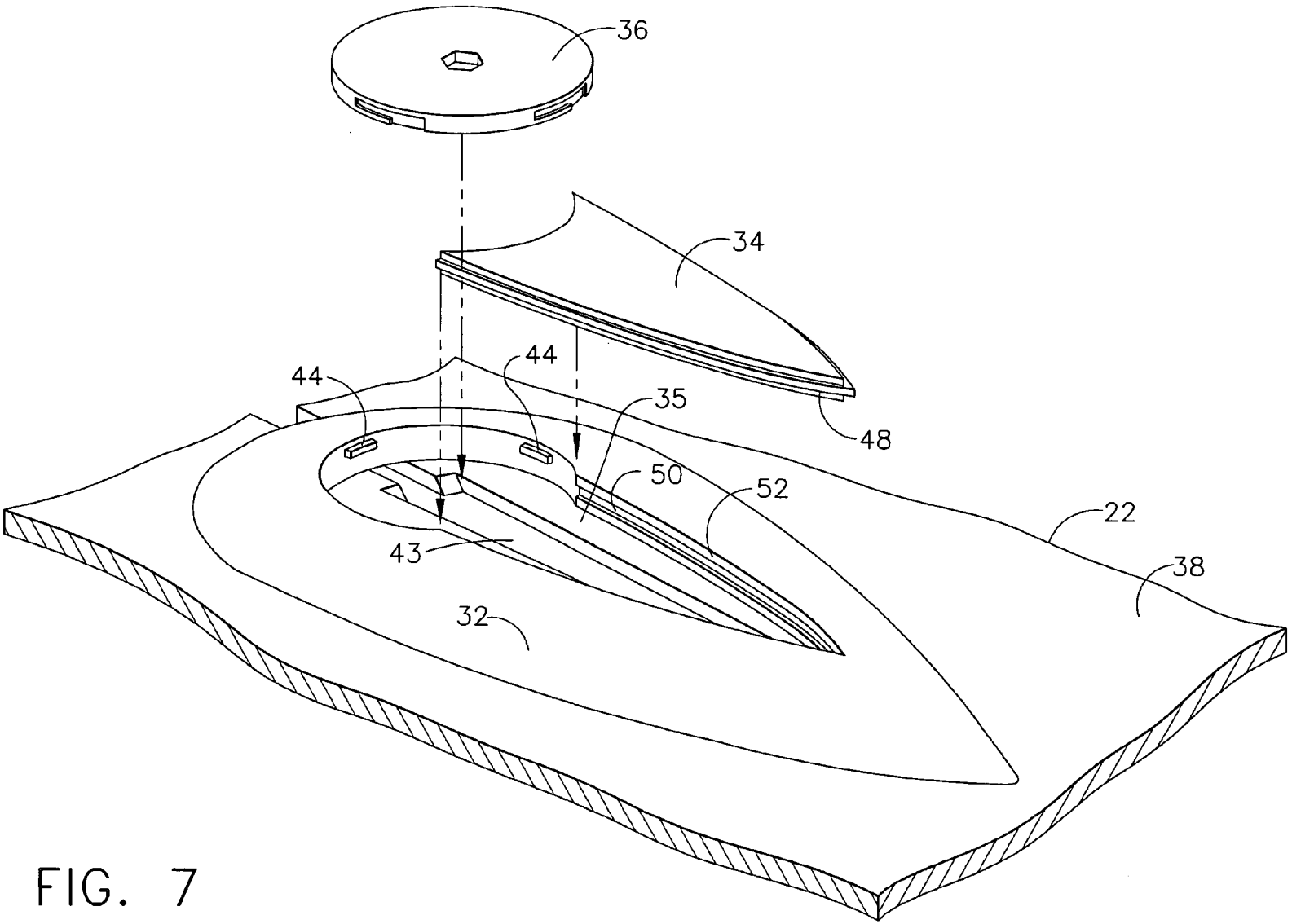
FIG. 7 is an exploded view of the seal/locking apparatus and a portion of the engine shown in FIG. 3, with arrows indicating the relationship of major components.

In prior art aircraft engines 10, rear struts 26 are part of a weldment that must be taken out of engine 10 whenever a rear strut 26 must be replaced for some reason. However, in configurations of the present invention, a single rear strut 26 selected for replacement can advantageously be individually removed and replaced without removing a weldment. More particularly, and referring to FIG. 7, seal/locking apparatus 30 is attached, e.g., by brazing housing 32, to a diffuser wall 22 of an aircraft engine 10 so that a slot 43 in diffuser wall 22 is under a longitudinal axis of opening 35 in housing 32. Locking cap 36 is removed by twisting it to disengage it from lug(s) 44 and lug(s) 46 (not all of which are shown in FIG. 7) and then lifting it out. The removal of locking cap 36 frees cover 34 to slide in opening 35 of housing 32 to thereby disengage flange 48 from engagement with slot 50 in an inside rim 52 of housing 32. The disengagement of flange 48 allows cover 34 to be lifted up, exposing an open slot 43 of diffuser wall 22 under tapered keyhole-shaped opening 35 of housing 32. The tapered shape (for example, an "almond-like" shape) of cover 34 facilitates engagement and disengagement of flange 48 with slot 50 when cover 34 is slid against the mating portion of tapered keyhole-shaped opening 35 in the plane of housing 32. The engagement of flange 48 with slot 50 effectively prevents cover 34 from popping out of place and strut 26 from becoming disengaged prematurely when locking cap 36 is removed or before locking cap 36 is secured.

Aft or rear strut 26 is then removed, for example, by lifting it though slot 43. In some configurations, the geometry may allow aft or rear strut 26 to be removed without lifting it through slot 43, once the pressure of cover 34 and leaf spring 40 is removed. (Although not shown in the Figures, a base portion of aft strut 26 distal to slot 43 includes an engagement member, for example, one or more pins, flanges, or recesses, that are configured to engage corresponding holding structure (s) on rear frame hub 28. Aft strut 26 in some configurations is hollow, with a base mounting structure, not shown in the Figures, welded thereto. A solid closure is provided at the opposite end of aft strut 26 in some configurations.

Replacement of rear strut 26 then includes inserting a replacement strut 26 into slot 43 (or, in configurations in which geometry permits, positioning it from another direction) so that an engagement member (not shown) on replacement strut 26 engage with the corresponding holding structure(s) on rear frame hub 28. Rear strut 26 is then held in position while cover 34 is lowered into housing 32 and slid into place, thereby engaging flange 48 into slot 50 in rim 52 of opening 35 and compressively holding replacement strut 26 with leaf spring 40. Next, locking cap 36 is inserted into the remaining opening in cover 34 and turned to engage lug(s) 44 and lug(s) 46. Simultaneously in some configurations, spring washer 42 seats against cover 34 and housing 32 to compressively hold cover 34 in place. Seal/locking system 30 thereby provides an airtight cover seal that effectively locks to hold replacement strut 26 in place.

Thus, configurations of the present invention allow replacement of a rear strut of an aircraft engine without removal of the engine from the aircraft from which it is hung. The engine does not have to be shipped to a repair facility, and the replacement can be performed "on-line" on operating aircraft. The locking/seal arrangement described herein can be used in apparatus other than aircraft engines, as well, and/or need not be configured so as to hold a strut in place.

While the invention has been described in terms of various specific embodiments, those skilled in the art will recognize that the invention can be practiced with modification within the spirit and scope of the claims.

What is claimed is:

1. A seal/locking apparatus comprising:

a tapered cover;

a leaf spring attached to an inside portion of said tapered cover;

a locking cap;

and a housing having a opening therein configured to engage, in a first part of said opening, said tapered cover, and in a second portion of said opening, said locking cap;

wherein said tapered cover and said locking cap are configured to cooperate in preventing removal of either from said housing when both are engaged in said opening unless said locking cap is removed first.

2. An apparatus in accordance with claim 1 wherein said locking cap is configured to seal and lock said seal/locking apparatus by rotation.

3. An apparatus in accordance with claim 2 wherein said tapered cover and said locking cap each comprise one or more lugs configured to engage a mating portion of said locking cap and said tapered cover.

4. An apparatus in accordance with claim 1 wherein said tapered cover comprises a flange configured to engage with a slot in a rim of said opening.

5. An apparatus in accordance with claim 1 wherein said housing is configured to engage with said tapered cover by sliding said tapered covered in said opening.

6. An apparatus in accordance with claim 1 wherein said locking cap further comprises a spring washer configured to compressively engage said tapered cover and said housing when said locking cap is fitted in said seal/locking apparatus.

7. An apparatus in accordance with claim 1 mounted on a diffuser wall of an aircraft engine so that a slot in the diffuser wall is under a longitudinal axis of the opening in said housing.

8. An apparatus in accordance with claim 7 further comprising a leaf spring attached to a face of said tapered cover and a removable strut configured to engage a rear frame hub of the aircraft engine and to be held compressively in place by said leaf spring, when said tapered cover is engaged in the opening of said housing.

9. An apparatus in accordance with claim 8 further comprising a spring washer configured to compressively engage said tapered cover and said housing when said locking cap is fitted in said seal/locking apparatus.

10. A aircraft engine amenable to servicing of portions therein, said aircraft engine comprising:

a rear frame hub;

a removable strut having an engagement member configured to engage said rear frame hub;

a diffuser wall having a slot therein;

a housing having an opening therein and attached to said diffuser wall, so that said slot is under a longitudinal axis of the opening in said housing;

a tapered cover; and a locking cap, wherein said tapered cover configured to engage in a first part of said opening and said locking cap configured to engage in a second portion of said opening, said tapered cover and said locking cap configured to cooperate in preventing removal of either from said housing when both are engaged in the opening unless said locking cap is removed first, and said tapered cover configured to engage said removable strut when said removable strut is engaged with said rear frame hub and said tapered covered is engaged with said housing.

11. An engine in accordance with claim 10 wherein said locking cap includes a bayonet mount and said locking cap is further configured to compressively engage said tapered cover and said housing using a spring washer.

12. An engine in accordance with claim 10 further comprising a leaf spring on said tapered cover, said leaf spring configured to compressively engage said removable strut.

13. A method for servicing a strut in an aircraft engine, said method comprising:

inserting a strut in the engine;

inserting and engaging a cover of a seal/locking apparatus in a first part of an opening of a housing of the seal/locking apparatus to compressively engage the strut between a hub of the engine and the cover through a slot in a diffuser wall of the engine; and engaging a locking cap with the cover and the housing of the seal/locking apparatus in a second part of the opening of the housing to thereby effectively lock and seal the seal/locking apparatus.

14. A method in accordance with claim 13 further comprising compressing a leaf spring on the cover against the inserted strut.

15. A method in accordance with claim 14 wherein engaging the locking cap comprises turning the locking cap to engage a bayonet mount.

16. A method in accordance with claim 15 wherein said engaging the locking cap further comprises compressing a spring washer.

17. A method in accordance with claim 13 wherein said strut is an inserted strut, said method further comprising removing a strut selected for replacement, wherein said removal of said strut selected for replacement comprises:

removing the locking cap from the second part of the opening in the seal/locking apparatus;

removing the cover engaged in the first part of the opening in the seal/locking apparatus to expose the slot in the diffuser wall; and removing the strut to be replaced from the aircraft engine; and further wherein the inserted strut replaces the removed strut.

18. A method in accordance with claim 17 wherein said removing the locking cap comprises turning the locking cap to engage a bayonet mount.

19. A method in accordance with claim 18 wherein said removing the strut to be replaced comprises lifting the strut to be replaced through the opening in the seal/locking apparatus, through a slot in the diffuser wall of the engine.

* * * * *